US008798486B2

(12) United States Patent
Kitazawa

(10) Patent No.: US 8,798,486 B2
(45) Date of Patent: Aug. 5, 2014

(54) IMAGE FORMING APPARATUS, NON-TRANSITORY COMPUTER READABLE MEDIUM AND IMAGE FORMING METHOD

(71) Applicant: Fuji Xerox Co., Ltd., Tokyo (JP)

(72) Inventor: Yoshiyuki Kitazawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 21 days.

(21) Appl. No.: 13/749,014

(22) Filed: Jan. 24, 2013

(65) Prior Publication Data

US 2014/0010557 A1 Jan. 9, 2014

(30) Foreign Application Priority Data

Jul. 5, 2012 (JP) ..... 2012-151779

(51) Int. Cl.
*G03G 21/20* (2006.01)
*G03G 15/00* (2006.01)
*G03G 15/16* (2006.01)

(52) U.S. Cl.
CPC ..... *G03G 21/20* (2013.01); *G03G 15/5062* (2013.01); *G03G 15/1695* (2013.01)
USPC ..... 399/15; 399/92; 399/390

(58) Field of Classification Search
CPC ..... G03G 15/5062; G03G 21/20; G03G 2221/1645; G03G 15/1695; G03G 15/6502
USPC ..... 399/15, 92, 390, 393
See application file for complete search history.

(56) References Cited

U.S. PATENT DOCUMENTS

| | | | | |
|---|---|---|---|---|
| 6,015,144 | A | 1/2000 | Yoshii et al. | |
| 7,016,641 | B2 * | 3/2006 | Matsumoto et al. | 399/390 |
| 8,437,683 | B2 * | 5/2013 | Suzuki | 399/397 |

FOREIGN PATENT DOCUMENTS

| | | |
|---|---|---|
| JP | A 11-5643 | 1/1999 |
| JP | A 2001-31273 | 2/2001 |
| JP | A 2001-48366 | 2/2001 |
| JP | A 2011-63345 | 3/2011 |

* cited by examiner

*Primary Examiner* — Hoang Ngo
(74) *Attorney, Agent, or Firm* — Oliff PLC

(57) ABSTRACT

Provided is an image forming apparatus including a container which contains plural sheets, an image forming unit which forms an image on each of the sheets supplied from the container, a detecting unit which detects an image density of the image formed on the sheets by the image forming unit, a blowing unit which blows air to the sheet contained in the container, and a blowing control unit which controls the blowing unit based on the image density detected by the detecting unit.

20 Claims, 7 Drawing Sheets

UNIT (%)

| 4 | 3 | 2 | AREA |
|---|---|---|---|
| Y : 20<br>M : 20<br>C : 10<br>K : 0<br>ALL : 50 | Y : 15<br>M : 15<br>C : 10<br>K : 0<br>ALL : 40 | Y : 5<br>M : 5<br>C : 5<br>K : 0<br>ALL : 15 | B |
| Y : 40<br>M : 40<br>C : 15<br>K : 0<br>ALL : 95 | Y : 35<br>M : 35<br>C : 15<br>K : 0<br>ALL : 85 | Y : 15<br>M : 15<br>C : 10<br>K : 0<br>ALL : 40 | C |
| Y : 30<br>M : 25<br>C : 15<br>K : 0<br>ALL : 70 | Y : 25<br>M : 15<br>C : 10<br>K : 0<br>ALL : 50 | Y : 25<br>M : 20<br>C : 10<br>K : 0<br>ALL : 55 | D |

IMAGE FORMING APPARATUS, NON-TRANSITORY COMPUTER READABLE MEDIUM AND IMAGE FORMING METHOD

CROSS-REFERENCE TO RELATED APPLICATIONS

This application is based on and claims priority under 35 USC 119 from Japanese Patent Application No. 2012-151779 filed Jul. 5, 2012.

BACKGROUND

Technical Field

The present invention relates to an image forming apparatus, a non-transitory computer readable medium and an image forming method.

SUMMARY

According to an aspect of the invention, there is provided an image forming apparatus including a container which contains plural sheets, an image forming unit which forms an image on each of the sheet supplied from the container, a detecting unit which detects an image density of the image formed on each of the sheet by the image forming unit, a blowing unit which blows air to the sheets contained in the container, and a blowing control unit which controls the blowing unit based on the image density detected by the detecting unit.

BRIEF DESCRIPTION OF THE DRAWINGS

An exemplary embodiment of the present invention will be described in detail based on the following figures, wherein.

DETAILED DESCRIPTION

Figure 1:
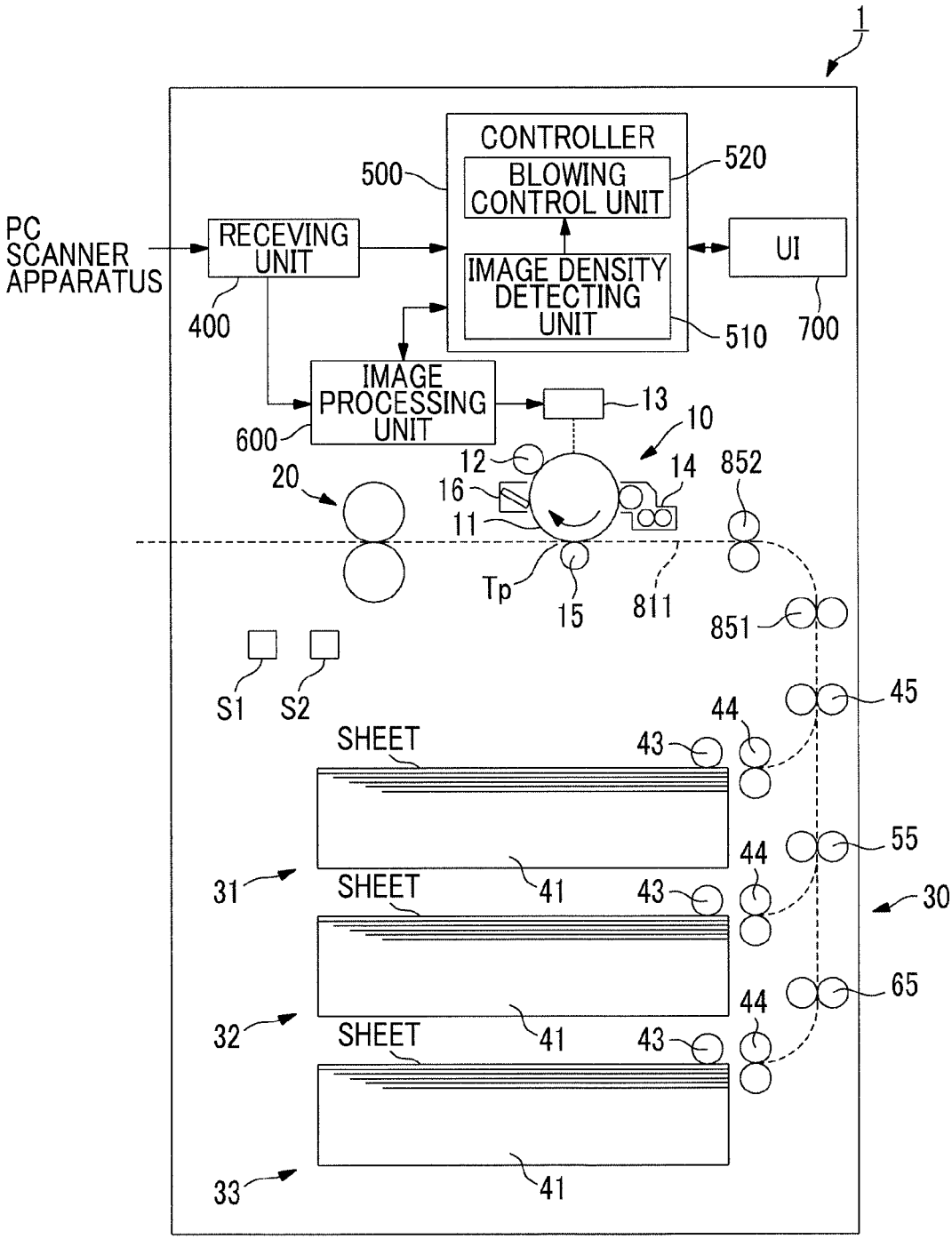
FIG. 1 is a view illustrating a schematic configuration of an image forming apparatus to which an exemplary embodiment is applied.

Hereinafter, an exemplary embodiment of the present invention will be described referring to the accompanying drawings. FIG. 1 is a view illustrating a schematic configuration of an image forming apparatus 1 to which an exemplary embodiment is applied. In the image forming apparatus 1, provided are an image forming unit 10 which forms a toner image on a sheet, a fixing unit 20 which fixes the toner image formed on the sheet by the image forming unit 10 to the sheet, and a sheet supply unit 30 which supplies a sheet to the image forming unit 10.

The image forming unit 10 functioning as an image forming unit includes a photoreceptor drum 11, a charging device 12, an exposure device 13, a developing device 14, a transfer device 15 and a cleaning device 16. Among these, the photoreceptor drum 11 has a photoreceptor layer on the outer circumferential surface thereof and rotates in the direction denoted by the arrow in FIG. 1. The charging device 12 charges the rotating photoreceptor drum 11 to a predetermined electrical potential using a charging roller in contact with the photoreceptor drum 11. The exposure device 13 selectively exposures the photoreceptor drum 11 charged to the predetermined electrical potential using the charging device 12 to form an electrostatic latent image. Further, the developing device 14 develops the electrostatic latent image formed on the photoreceptor drum 11 with a toner to form the toner image on the photoreceptor drum 11.

The transfer device 15 is formed to have a roller shape and is provided along the axial direction of the photoreceptor drum 11 so as to be disposed to come into contact with the photoreceptor drum 11. Further, an opposing part where the photoreceptor drum 11 and the transfer device 15 oppose each other, that is, a position where the toner image held on the photoreceptor drum 11 is transferred onto the sheet is referred to as a transfer part Tp hereinafter. The transfer device 15 transfers the toner image on the photoreceptor drum 11 onto the sheet by applying bias to the transfer part Tp. In addition, the transfer device 15 transfers the toner image on the photoreceptor drum 11 onto the sheet by generating an electric field between the transfer device 15 and the photoreceptor drum 11. The cleaning device 16 eliminates the toner and the like remained on the photoreceptor drum 11 after the transfer.

The sheet supply unit 30 includes a first sheet feeding unit 31 to a third sheet feeding unit 33 so as to supply different sizes of sheets to the image forming unit 10. Here, the first sheet feeding unit 31 to third sheet feeding unit 33 are similarly configured.

In describing the first sheet feeding unit 31 as an example, the first sheet feeding unit 31 includes a sheet container 41, a retractable feed roller 43 and a handling mechanism 44. Among these, the sheet container 41 has a shape of a rectangular parallelepiped of which the upper part is open, and contains sheets inside thereof. The retractable feed roller 43 comes into contact with the uppermost sheet of the sheet bundle contained in the sheet container 41 to feed the uppermost sheet to the handling mechanism 44 side. The handling mechanism 44 includes, for example, a feed roller rotationally disposed and a retard roller of which rotation is restricted, to handle the sheet fed from the retractable feed roller 43 one by one.

The sheet supply unit 30 includes a first transport roller 45, a second transport roller 55 and a third transport roller 65. The first transport roller 45 is configured of a pair of roller-shaped members to further transport the sheet fed from the handling mechanism 44 of the first sheet feeding unit 31, to the downstream side. The second transport roller 55 is configured of a pair of roller-shaped members to transport the sheet fed from the handling mechanism 44 of the second sheet feeding unit 32, to the first transport roller 45. The third transport roller 65 is configured of a pair of roller-shaped members to transport the sheet fed from the handling mechanism 44 of the third sheet feeding unit 33, to the second transport roller 55.

A pre-registration roller 851 and a registration roller 852 are installed in the sheet passage 811 provided on the downstream side of the first transport roller 45. The pre-registration roller 851 further transports the sheet transported by the first transport roller 45 downstream and forms a loop in cooperation with the registration roller 852. The registration roller 852 stops once in order to temporarily stop the transport of the sheets and restarts the rotation in accordance with the timing, thereby supplying the sheets while adjusting registration with respect to the transfer part Tp.

In addition, in the image forming apparatus 1, the receiving unit 400 which receives image data from a personal computer or a scanner (not shown) is provided. Further, there is provided a controller 500 which controls all operations of the image forming unit 10, the fixing unit 20 and the sheet supply unit 30. An image processing unit 600 is also provided which performs image processing on the image data received by the receiving unit 400 and then outputs the image data to the exposure device 13. Further, there is provided a user interface (UI) 700 which is configured with a display panel, receives commands from the user and displays a message to the user. The image forming apparatus 1 includes a temperature sensor S1 which measures the temperature inside of the image forming apparatus 1 and a humidity sensor S2 which measures the humidity inside of the image forming apparatus 1.

In addition, the controller 500 includes a Central Processing Unit (CPU), a Read Only Memory (ROM), a Random Access Memory (RAM), and a Hard Disk Drive (HDD) (all of these are not shown). The CPU executes the processing programs of the processes described below. Various programs, various tables, parameters and the like are stored in the ROM. The RAM is used as a work area when the various programs are executed by the CPU. In addition, the controller 500 performs the various programs stored in the ROM, and functions as an image density detecting unit 510 which detects the image density of the image formed on the sheet and a blowing controller 520 which controls air blowing onto the sheet (described later).

Following is a description about the operation of the image forming apparatus 1.

In the image forming apparatus 1 of the present exemplary embodiment, first, transport of the sheet is started by the sheet supply unit 30 including the retractable feed roller 43, the handling mechanism 44, the first transport roller 45, the second transport roller 55, the third transport roller 65, the pre-registration roller 851 and the registration roller 852. Specifically, the sheets are transported from the sheet container 41, provided in any one of the first sheet feeding unit 31 to the third sheet feeding unit 33, by the retractable feed roller 43. Next, the sheets are transported to the transfer part Tp by the pre-registration roller 851, the registration roller 852 and the like.

On the other hand, in the image forming unit 10, the surface of the photoreceptor drum 11 charged by the charging device 12 is exposed by the exposure device 13 so that an electrostatic latent image is formed on the surface of the photoreceptor drum 11. The formed electrostatic latent image is developed as a toner image by the developing device 14. Then, the toner image formed on the photoreceptor drum 11 is transferred onto the sheet transported by the registration roller 852, in the transfer part Tp. Next, the sheet onto which the toner image is transferred receives the fixing process in the fixing unit 20. Then, the sheet is stacked on a sheet stacker (not shown) provided outside of the image forming apparatus 1.

Further, in FIG. 1, the image forming apparatus 1 is shown in which one image forming unit 10 is provided to form a monochromatic image. However, the process described below may be applied to a so-called tandem image forming apparatus in which four image forming units which respectively form four color toner images of, for example, yellow (Y), magenta (M), cyan (C) and black (B) are provided, and which sequentially transfers the toner images from the image forming units to the sheets. In addition, in the tandem image forming apparatus, there may be a case where the toner images are directly transferred from the four image forming units onto the sheets, or a case where the toner images are transferred from the four image forming units onto an intermediate transfer body such as a circulating moving belt member and then the toner images are transferred from the intermediate transfer body onto the sheets.

Figure 2:
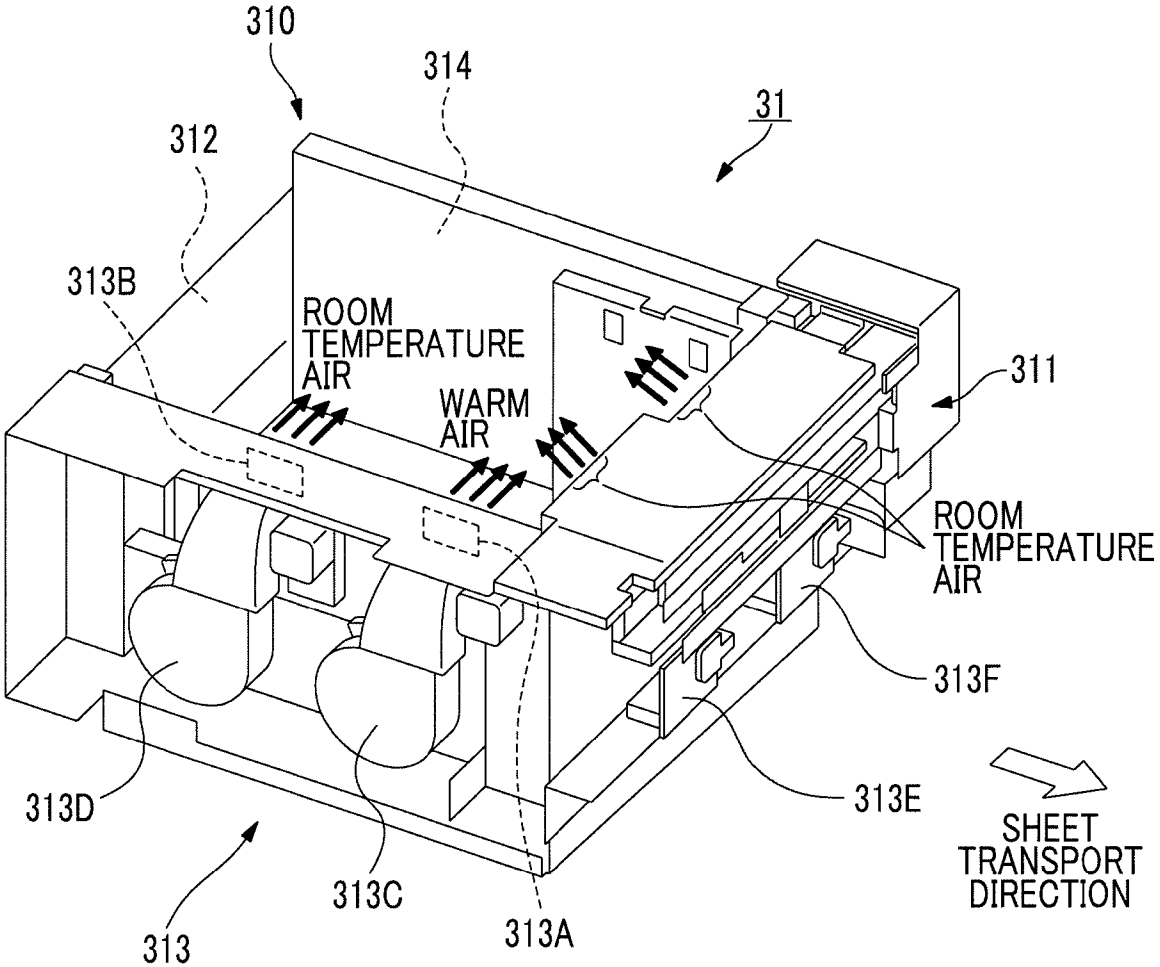
FIG. 2 is a perspective view explaining the configuration of a first sheet feeding unit.

FIG. 2 is a perspective view explaining the configuration of the first sheet feeding unit 31. Further, the second sheet feeding unit 32 and the third sheet feeding unit 33 are also configured in the same manner as the first sheet feeding unit 31.

As shown in FIG. 2, in the first sheet feeding unit 31, a case body 310 formed in a box shape is provided. The case body 310 includes a first side wall 311 disposed on the further downstream side of the sheet transport direction than the sheet to be contained and a second side wall 312 disposed in the location opposing the first side wall 311. On the front side of FIG. 2, a third side wall 313 is provided along the transport direction of the sheet, and a fourth side wall 314 is provided in the location opposing the third side wall 313.

In addition, on the surface side opposing the sheet in the third side wall 313, two openings of a first opening 313A and a second opening 313B are provided. Further, the first opening 313A side is located on the further downstream side in the transport direction of the sheet than the second opening 313B. In the third side wall 313, a first blower 313C and a second blower 313D functioning as a part of a blowing unit are provided. Here, the first blower 313C blows out air to the first opening 313A. Further, the second blower 313D blows out air to the second opening 313B. In the exemplary embodiment, a heater (not shown) is provided as an example of a heating source which heats air blown out from the first blower 313C.

Since the exemplary embodiment has such a configuration, the warm air is blown out from the first opening 313A. Further, air with a temperature of room temperature (room temperature air) is blown out from the second opening 313B. The warm air and the room temperature air blows from the lateral sides of the stacked sheets (the sheet bundle) onto the sheet bundle. This forces air to enter between the sheets, thus the sheets which are in close contact are easily separated from each other. As a result, in the present exemplary embodiment, it becomes difficult for so-called multi feed to occur in which plural stacked sheets are transported.

In the exemplary embodiment, two openings (not shown) are provided on the surface side opposing the sheet in the first side wall 311. There are provided a third blower 313E which blows air to the opening on one side of the two openings and a fourth blower 313F which blows air to the opening on the other side of the two openings. As a result, in the exemplary embodiment, the room temperature air may blow even to the part located on the downstream side in the transport direction of the sheet in the sheet bundle.

Figure 3:
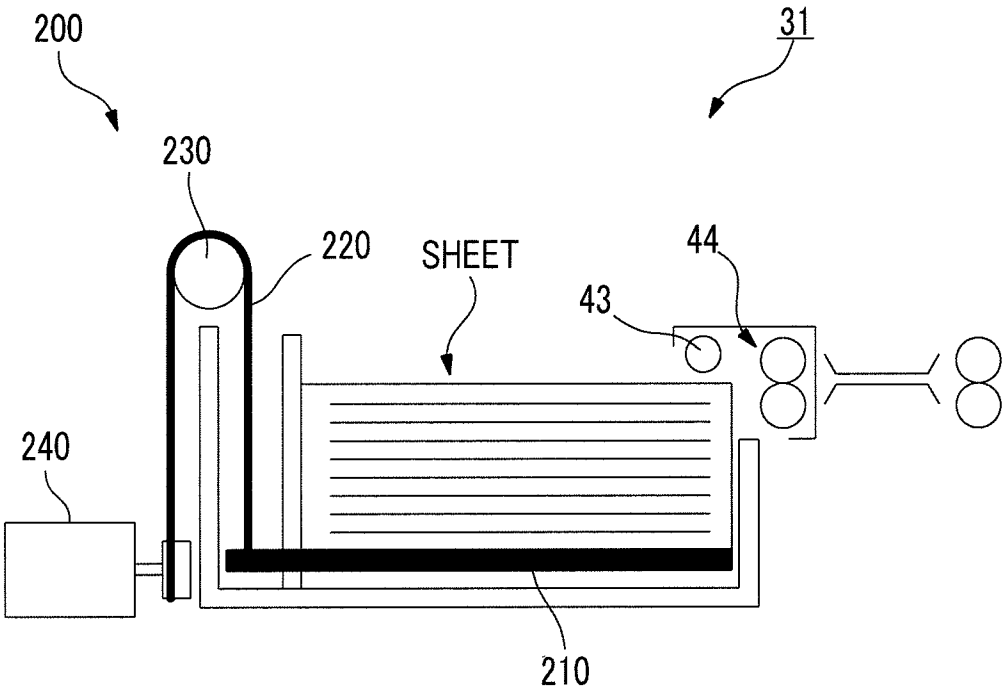
FIG. 3 is a cross-sectional view of the first sheet feeding unit when viewed from a third side wall.

FIG. 3 is a cross-sectional view of the first sheet feeding unit 31 when viewed from a third side wall 313. A sheet lifting mechanism 200 which lifts the sheet bundle up and causes the uppermost sheet of the sheet bundle to come into contact with the retractable feed roller 43 is provided in the first sheet feeding unit 31 in the exemplary embodiment. The sheet lifting mechanism 200 includes a bottom plate 210 located in the lower part of the sheet bundle, which supports the sheet bundle from the lower part, and a wire 220 of which one edge is attached to the bottom plate 210.

The sheet lifting mechanism 200 includes a pulley 230 located in the upper part higher than the bottom plate 210, which supports the wire 220, and a motor 240 located in the lower part lower than the pulley 230, which winds the wire 220. Here, in the exemplary embodiment, if the motor 240 is rotated, the wire 220 is wound. Due to this, the bottom plate 210 rises so that the uppermost sheet out of the sheet bundle on the bottom plate 210 comes into contact with the retractable feed roller 43.

Figure 4:
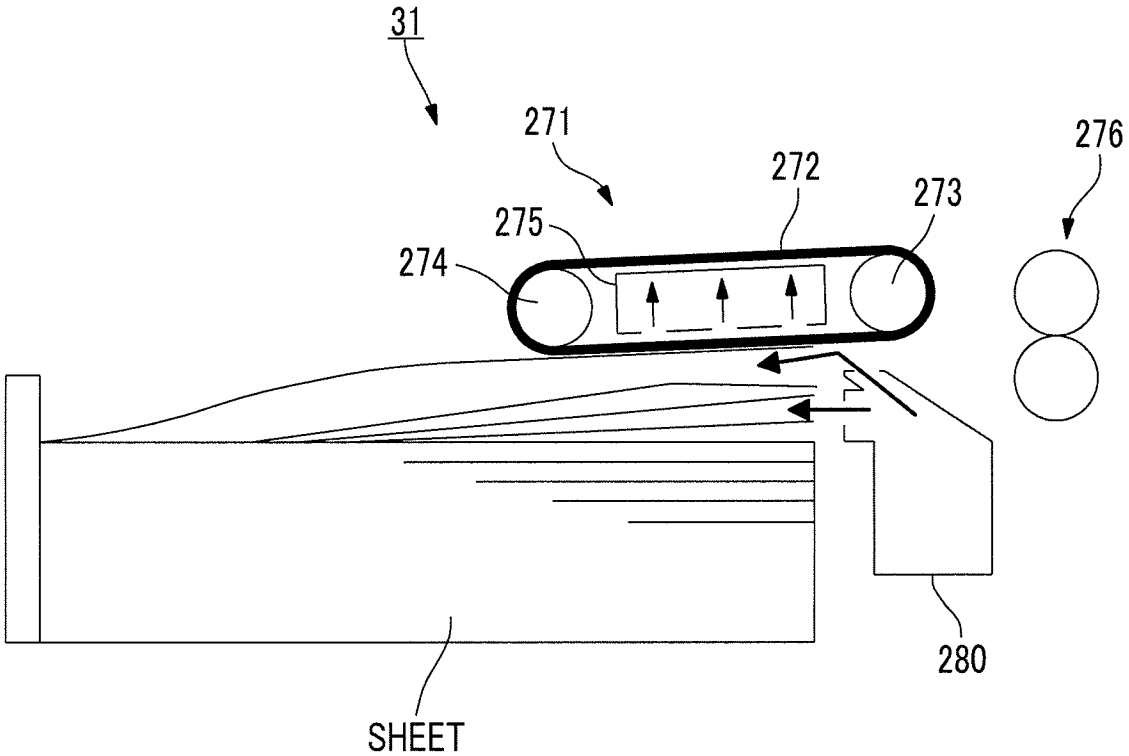
FIG. 4 is a view illustrating another configuration example of the first sheet feeding unit.

FIG. 4 is a view illustrating another configuration of the first sheet feeding unit 31.

In the configuration example shown in FIG. 4, in the upper part of the stacked sheets a transport device 271 which transports the uppermost sheet of the sheet bundle is provided. The transport device 271 is provided with a belt member 272 which is formed in an endless shape, on which a penetration hole is formed and which is configured so that air may flow from the outside to the inside thereof. In addition, a driving roller 273 is provided which is disposed inside of the belt member 272 and rotates in the counter-clockwise direction in the drawing to rotationally drive the belt member 272.

Further, the transport device 271 includes a supporting roller 274 disposed inside of the belt member 272 to support the belt member 272 from the inside. The transport device 271 includes a suction device 275 disposed inside of the belt member 272 to suck the air outside of the belt member 272 through the penetration hole (not shown) formed in the belt member 272. Further, the exemplary embodiment includes a moving device (not shown) which vertically lifts and lowers the whole body of the transport device 271.

In the first sheet feeding unit 31 in FIG. 4, when the sheet is delivered, the transport device 271 is lowered down by the moving device and the uppermost sheet of the sheet bundle is sucked and held by the transport device 271. Next, after the transport device 271 is lifted up by the moving device, the driving roller 273 starts to rotate. Due to this, the delivery of the sheets is started toward the downstream side of the sheets. Further, in the downstream side of the transport device 271, a pair of transport rollers 276 which transports the sheet further to the downstream side is provided, and the sheets delivered by the transport device 271 is transported further to the downstream side by the transport roller 276.

Not shown in FIG. 4, even the configuration example shown in FIG. 4, which has the first opening 313A and the second opening 313B as shown in FIG. 2 provided on the lateral sides of the sheet bundle, thus it is configured such that the warm air reaches the part which is the lateral side of the sheet bundle and located on the downstream side in the transport direction, and the room temperature air reaches the part which is the lateral side of the sheet bundle and located on the upstream side in the transport direction. In addition, even in the present configuration example, as shown in FIG. 4, a blower 280 is provided on the further downstream side in the sheet transport direction than the sheet bundle, thus it is configured such that the room temperature air reaches the leading edge unit (the edge unit located on the downstream side in the sheet transport direction) of the sheet bundle.

Figure 5:
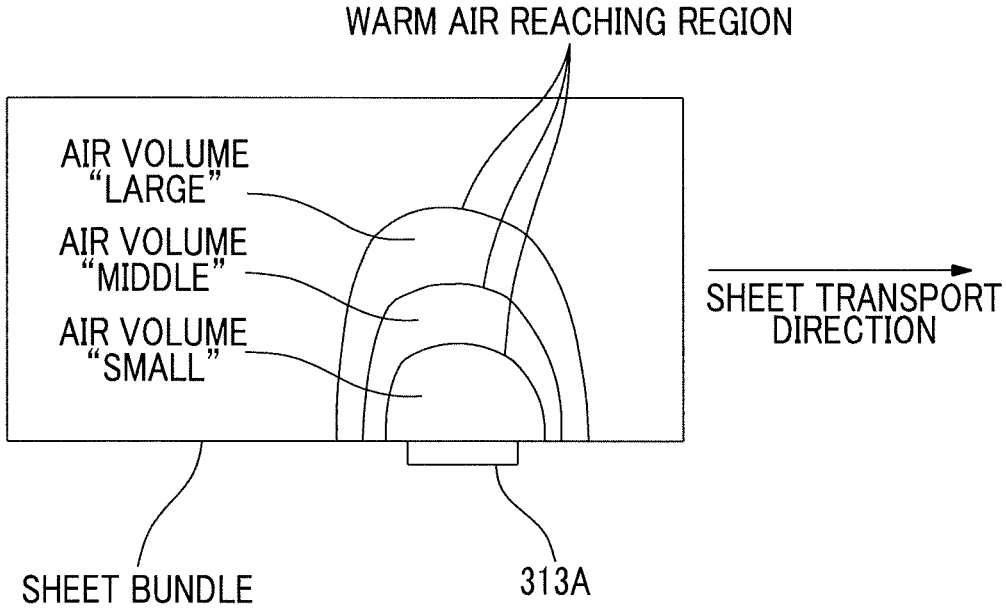
FIG. 5 is a view of a sheet bundle contained in the first sheet feeding unit when viewed from the upper side.

FIG. 5 is a view of a sheet bundle contained in the first sheet feeding unit 31 when viewed from the upper side.

In the exemplary embodiment, as described above, it is configured such that the warm air reaches the sheet bundle from the first opening 313A. Though the description thereof is omitted above, in the exemplary embodiment, the air volume of when the warm air reaches the sheet bundle may be adjusted (it is configured to make the warm air reach with the air volume being "large", "middle" and "small"), as shown in FIG. 5, as the air volume becomes large, air (wind) may reach the back side of the sheet bundle. In addition, as the air volume becomes large, the region which the warm air reaches (hereinafter, referred to as "a warm air reaching region") becomes broad.

Incidentally, if the warm air reaches the sheet, the part which the warm air reaches is dried, thus each part of the sheet has different electrical resistivity. Here, as the exemplary embodiment, in an electrophotography method which transfers a toner image onto the sheet by electrostatic action, if each part of the sheet has different electrical resistivity in this manner, a transfer capability is affected when the toner image is transferred onto the sheet. Specifically, when an image having high image density is formed on the sheet, unevenness easily occurs in the image.

In addition, unevenness, such as uneven brightness, occurs between the toner image to be transferred onto the part which the warm air reaches and the toner image to be transferred onto the part which the warm air does not reach, when the image having large image density is formed on the sheet. Further, in an image having low image density, though unevenness occurs similarly to the above, the unevenness is extremely small not to be noticable.

Therefore, in the exemplary embodiment, as a result of detecting the image density of the image formed on the sheet, if it is under the state where the image density is high so that unevenness easily occurs, a process to stop the blowing of warm air or a process to change the blowing condition is performed. In contrast, if it is under the state where the image density is low so that unevenness hardly occurs, a process to continue the blowing of the warm air is performed. Further, when the process to stop the blowing of warm air or the process to change the blowing condition is performed, with regard to the room temperature air, it is possible to continue blowing as it is, or it is possible to stop the blowing or change the blowing condition similar to the warm air.

Figure 6:
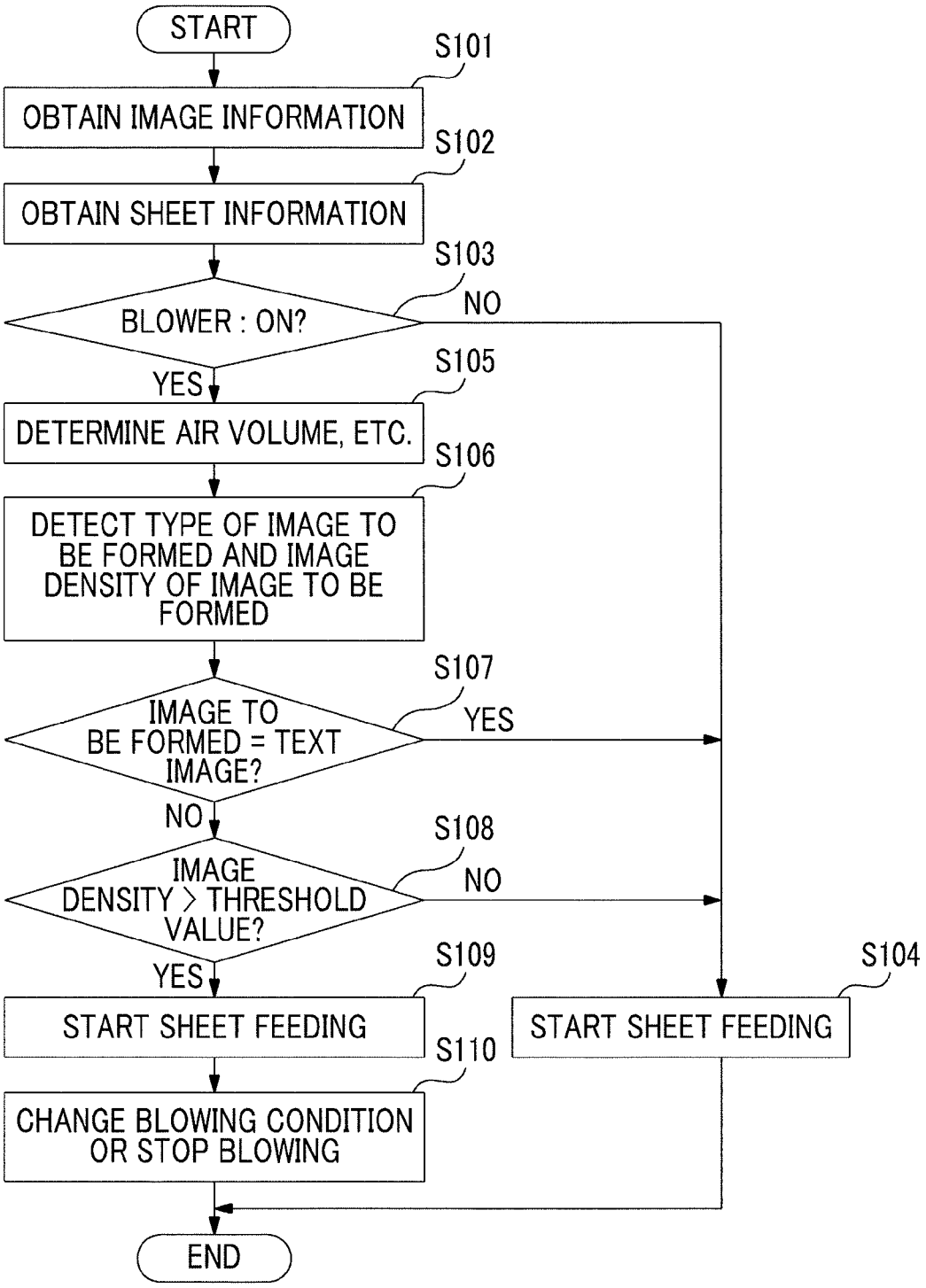
FIG. 6 is a flowchart showing a process performed by a controller with regard to air blowing to a sheet.

FIG. 6 is a flowchart showing a process performed by a controller 500 with regard to air blowing to a sheet. Further, the following description will be given about the case where the sheet is fed from the first sheet feeding unit 31, as an example.

As shown in FIG. 6, the controller 500 obtains image information sent from an external PC or a scanner apparatus through the receiving unit 400 (Step 101). Then, the controller 500 obtains sheet information relating to the sheet contained in the first sheet feeding unit 31 (Step 102). Specifically, information relating to the quality, the basis weight, the thickness, the size and the like of the sheet are obtained.

Furthermore, it is possible to obtain the sheet information input by the user through UI 700. For example, a sensor is provided in the first sheet feeding unit 31 and the sheet information may be obtained using the sensor. Since the sheet information is obtained, it may be determined whether the sheet contained in the first sheet feeding unit 31 is a sheet being easily transported or a sheet being easily multi-fed.

Next, the controller 500, based on the sheet information obtained in Step 102, determines whether to turn on the blowers (the first blower 313C to fourth blower 313F) provided in the first sheet feeding unit 31 (Step 103). Here, in a case where the sheet specified by the obtained sheet information is, for example, a sheet being easily multi-fed such as a thick sheet, the controller 500 determines to turn on the blowers.

On the other hand, in a case where the sheet specified using the obtained sheet information is, for example, a sheet being hardly multi-fed such as a coated sheet, the controller 500 determines not to turn on the blowers. In addition, in the exemplary embodiment, it is determined based on the sheet information, whether to turn on the blowers, however it may be determined whether to turn on the blowers by adding the output from the temperature sensor S1 (refer to FIG. 1) or the output from the humidity sensor S2.

Here, when it is determined not to turn on the blowers in Step 103, the controller 500 starts to feed the sheet from the first sheet feeding unit 31 in the state where the blowers are not turned on (keeping the blower off) (Step 104). On the other hand, when it is determined to turn on the blowers in Step 103, the controller 500 determines the air volume or the temperature of the air of when air is blown to the sheet using the blowers (Step 105). Next, the controller 500 detects the kind of the image supposed to be formed, based on the image information obtained in Step 101, and the image density detecting unit 510 (refer to FIG. 1) detects the image density of the image supposed to be formed, based on the image information obtained in Step 101 (Step 106).

In addition, in Step 106, the image density of the image supposed to be formed on the above-described warm air reaching region (refer to FIG. 5) out of all the images to be formed is detected. Further, in Step 106, the image density of the image formed on the sheet is detected for each image formed on each sheet of the plural sheets contained in the sheet container 41. In Step 106, the image supposed to be formed on the warm air reaching region is divided into plural regions and the image density is detected for each region. If it is specifically described referring to FIG. 7A (a figure showing an example of an image to be formed and showing the image density of each region), the image density in each region of total nine regions of "B2" to "B4", "C2" to "C4" and "D2" to "D4" is detected.

Then, as shown in Step 107 of FIG. 6, the controller 500 determines whether the image supposed to be formed is a text image or not, based on the kind of the image detected in Step 106. In a case where the controller 500 determines that the image supposed to be formed is the text image, the controller 500 performs the process of Step 104. That is, sheet feeding is started from the first sheet feeding unit 31.

Further, when the sheet feeding is started from the first sheet feeding unit 31, the blowing control unit 520 turns on the first blower 313C to fourth blower 313F and turns on the heater such that the air volume and the temperature becomes the air volume and the temperature which are determined in Step 105. Due to this, after air having the temperature and the air volume in which multi-feeding of the sheet is not likely to occur is blown from the first opening 313A to fourth opening (not shown) onto the sheet, the sheet feeding is started from the first sheet feeding unit 31.

On the other hand, in a case where it is not determined that the image supposed to be formed is the text image in Step 107, the controller 500 determines whether the image density detected in Step 106 exceeds the predetermined threshold value (Step 108). More specifically, it is determined whether each image density exceeds the threshold value by comparing each image density detected for each region with the predetermined threshold value. If it is specifically described with reference to FIG. 7A, it is determined whether each image density in each region of nine regions of "B2" to "B4", "C2" to "C4" and "D2" to "D4" exceeds the threshold value.

In Step 108, if it is determined that any image density does not exceed the threshold value, the process in Step 104 is performed. That is, the sheet feeding is started from the first sheet feeding unit 31. Further, even in this case, similar to the above, the blowing control unit 520 turns on the first blower 313C to fourth blower 313F and turns on the heater such that the air volume and the temperature become the air volume and the temperature which are determined in Step 105. Due to this, air having the temperature and the air volume in which multi-feeding of the sheet is not likely to occur is blown from the first opening 313A to fourth opening (not shown) onto the sheet.

On the other hand, in Step 108, when it is determined that any image density out of the plural image densities exceeds the threshold value, the controller 500 starts sheet feeding from the first sheet feeding unit 31 (Step 109), but at this time, after the blowing condition when blowing the warm air is changed, the blowing control unit 520 controls the blowing of the warm air or stops the blowing of the warm air (Step 110). In addition, in the exemplary embodiment, the air having the air volume or the temperature corresponding to the type of the sheet contained in the first sheet feeding unit 31 is blown (the air having the air volume or the temperature temporarily determined according to the type of the sheet is blown). However, when any image density exceeds the threshold value, the condition when blowing the warm air is changed, or the blowing is stopped.

Here, it will be precisely described about the process of Step 110.

In Step 108, when it is determined that any image density exceeds the predetermined threshold value, if the warm air is blown according to the predetermined setting (condition) as it is, the warm air is blown to the part of the sheet on which an image having high image density is supposed to be formed, and thus unevenness of the image easily occurs when the image is formed. Due to this, in the exemplary embodiment, in a case where the unevenness easily occurs, the blowing condition when blowing the warm air is changed, or the blowing is stopped.

Furthermore, examples of the blowing condition when blowing the warm air include, an air volume, a blowing direction, a temperature of the warm air, and the like. Here, the change of the blowing condition is performed, for example, by lowering the air volume, changing the blowing direction or lowering the temperature. Further, the change of the blowing direction may be performed, for example, by adjusting the air direction such that the air flows toward the direction in which the air does not reach the sheet bundle, by adjusting the air direction such that the air reaches the parts of the sheets, on which the image having lower image density is formed, or by adjusting the air direction such that the air reaches another sheet placed in the lower layer within the sheet bundle.

Figures 7A, 7B:
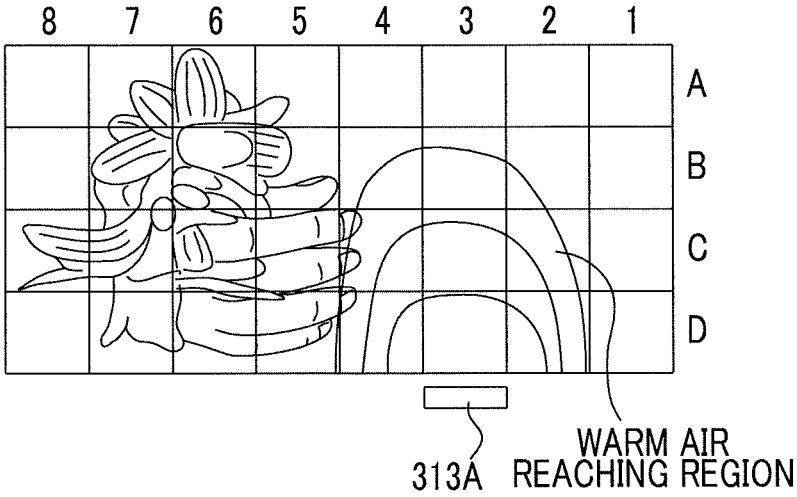
FIG. 7A is an illustration showing an example of an image to be formed and FIG. 7B is a table showing image density of each region.

Further, though the description thereof is omitted above, FIG. 7B shows an example of the image density in each of the nine regions located in the warm air reaching region. In the exemplary embodiment, in each region, detected are the image density of the image formed with yellow (Y) toner, the image density of the image formed with magenta (M) toner, the image density of the image formed with cyan (C) toner, and the image density of the image formed with black (B) toner. In addition, the image density of the image formed with the yellow (Y), the magenta (M), the cyan (C) and the black (B) toners being overlapped (the image density of the image formed with all toners, indicated as "ALL" in the figure) is also detected.

Further, for example, when the air volume is set as low in Step 105, the warm air reaches only the total three regions of "D2" to "D4" as shown in FIG. 7A, but the warm air does not reach regions of "B2" to "B4" and "C2" to "C4." In such a case, in Step 108, comparison of the image density with the threshold value may be performed in the three regions of "D2" to "D4." In addition, in Step 108 of the exemplary embodiment, while comparison of image densities with respect to all regions, that is, the nine regions, is not uniformly performed, comparison of image densities in the regions which the warm air reaches may be performed. To describe more, comparison of image densities may be performed in the regions which overlap the warm air reaching the region where the warm air is blown according to the air volume determined in Step 105.

Further, the threshold value, which is a subject of comparison of the image density, may be different for each region to be compared. For example, when comparison of the image density is performed in the regions of "B2" to "B4", the threshold value may be set to 300%. When comparison of the image density is performed in the regions of "C2" to "C4", the threshold value may be set to 250%. When comparison of the image density is performed in the regions of "D2" to "D4", the threshold value may be set to 200%.

Here, among the regions "B2" to "B4", the regions "C2" to "C4" and the regions "D2" to "D4", the regions "B2" to "B4" are separated the most from the first opening 313A and the regions "D2" to "D4" are closest to the first opening 313A. In this case, image unevenness is likely to occur more in the regions "D2" to "D4" than the regions "B2" to "B4." Therefore, in the above example, the threshold value is set as small when comparison is performed in the regions "D2" to "D4" in which image unevenness is likely to occur and the threshold value is set as large when comparison is performed in the regions "B2" to "B4" in which image unevenness is unlikely to occur.

In addition, as described above, in the case of changing the blowing condition or stopping the blowing, whereas image unevenness is unlikely to occur, multi-feeding is likely to occur. Therefore, in the case of changing the blowing condition or stopping the blowing, it is critical to notify the user of that the blowing condition is changed or the blowing is stopped, through UI 700 (refer to FIG. 1) functioning as a part of the notifying unit. Further, in this case, direct notification such as "the blowing is stopped, thus multi-feeding easily occurs" may be performed.

When the user is notified of that the blowing condition is changed or the blowing is stopped, the users may wish to change the blowing condition or cancel the stop of the blowing by himself or herself due to the concern of frequent occurrences of sheet jamming or multi-feeding. Therefore, in the exemplary embodiment, so as to satisfy the request of the user, it is configured to display a predetermined screen (not shown) on the UI 700 functioning also as a receiving unit, which enables the user to change the blowing condition or cancel the stop of blowing.

Further, though it is described above that the threshold value, which is a subject of comparison with the image density, is predetermined, it may be configured for the user to change the threshold value. For example, depending on the threshold value, the blowing may be frequently stopped and the paper jamming or multi-feeding may occur a lot. In the case of the configuration in which the user may change the threshold value, it may be configured such that defects such as frequent occurrences of paper jamming or multi-feeding are unlikely to occur. Furthermore, in the exemplary embodiment, the change of the threshold value by the user is received in the UI 700 functioning also as a receiving unit.

Further, it is described in the case of detecting the image density in the region to which the warm air is blown and changing the blowing condition and the like based on the image density. However, depending on the conditions such as the image density, there is a case where unevenness may occur even in the room temperature air. Therefore, the image density may be detected with regard to the part which the room temperature air reaches, and then the blowing condition and the like may be changed, based on the image density.

Further, the comparison of the image density with the threshold value may be performed in order to determine whether all image densities (the image density indicated as "ALL" in FIG. 7B) exceed the threshold value, or the comparison of the threshold value with the image density of the image for each color formed with yellow (Y), magenta (M), cyan (C) and black (B) toners may be performed.

In addition, the change of the blowing condition includes, for example, the case where the temperature of the blowing air is lowered by lowering the output of the heater or the case where the heater is turned off to make the room temperature air reach the sheet instead of the warm air. In this case, at the stage earlier than when the sheet, that is the subject, is started to be transported, the output of the heater may be lowered or the heater may be turned off. In addition, when it comes to the sheet of which the blowing condition needs to be changed (the sheet on which the image having a high image density is supposed to be formed), at the earlier stage than the timing when the sheet is transported, the heater may be turned off.

Furthermore, in the exemplary embodiment, plural sheets are stacked in the first sheet feeding unit 31. However, in this case, with regard to the sheet located in an upper part, the blowing condition is not changed because the image density of the image to be formed on the sheet is low, but with regard to the sheet located in a lower part, the blowing condition is changed because the image density of the image to be formed on the sheet is high. In this case, at the stage when the sheet located in the upper part is not yet transported (at the stage when the sheet located in the upper part is still stacked in the first sheet feeding unit 31), the output of the heater may be lowered or the heater may be turned off.

In a case where the output of the heater is lowered or the heater is turned off when the sheet located in the lower part (the sheet on which the image having a high image density is supposed to be formed) is transported, there is a possibility that the heater may not be readily cooled, and thus the warm air of a high temperature may be blown to the sheet located in the lower part. As is in the exemplary embodiment, in a case where the output of the heater is lowered in advance, the air of which the temperature is lowered down to the predetermined temperature is blown to the sheet.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a container which contains a plurality of sheets;

an image forming unit which forms an image on each of the sheets supplied from the container;

a detecting unit which detects an image density of the image formed on each of the sheets by the image forming unit;

a blowing unit which blows air to the sheets contained in the container; and a blowing control unit which controls the blowing unit based on the image density detected by the detecting unit.

2. The image forming apparatus according to claim 1, wherein the blowing control unit controls the blowing unit based on the image density of the image formed on a region of each of the sheets to which the air is blown by the blowing unit.

3. The image forming apparatus according to claim 2,
wherein in a case where the image density detected by the detecting unit is higher than a predetermined threshold value, the blowing control unit changes a blowing condition of when the blowing unit blows the air and controls the blowing unit based on the changed blowing condition.

4. The image forming apparatus according to claim 3, further comprising:
a notification unit which notifies a user of information relating to the changed blowing condition or information relating to the stopped blowing in a case where the blowing condition is changed or the blowing is stopped without blowing the air to the sheets.

5. The image forming apparatus according to claim 3,
wherein the blowing condition changed by the blowing control unit is configured to be changeable by a user, or the stopped blowing of the air to the sheet is configured to be cancellable by the user, and
wherein the image forming apparatus further comprises a receiving unit which receives from the user the changed blowing condition by the user or the user's cancellation of the stopped blowing.

6. The image forming apparatus according to claim 2,
wherein in a case where the image density detected by the detecting unit is higher than a predetermined threshold value, the blowing control unit controls the blowing unit not to blow the air to the sheets.

7. The image forming apparatus according to claim 6, further comprising:
a notification unit which notifies a user of information relating to the changed blowing condition or information relating to the stopped blowing in a case where the blowing condition is changed or the blowing is stopped without blowing the air to the sheets.

8. The image forming apparatus according to claim 6,
wherein the blowing condition changed by the blowing control unit is configured to be changeable by a user, or the stopped blowing of the air to the sheet is configured to be cancellable by the user, and
wherein the image forming apparatus further comprises a receiving unit which receives from the user the changed blowing condition by the user or the user's cancellation of the stopped blowing.

9. The image forming apparatus according to claim 1,
wherein in a case where the image density detected by the detecting unit is higher than a predetermined threshold value, the blowing control unit changes a blowing condition when the blowing unit blows the air and controls the blowing unit based on the changed blowing condition.

10. The image forming apparatus according to claim 9, further comprising:
a notification unit which notifies a user of information relating to the changed blowing condition or information relating to the stopped blowing in a case where the blowing condition is changed or the blowing is stopped without blowing the air to the sheets.

11. The image forming apparatus according to claim 9,
wherein the blowing condition changed by the blowing control unit is configured to be changeable by a user, or the stopped blowing of the air to the sheet is configured to be cancellable by the user, and
wherein the image forming apparatus further comprises a receiving unit which receives from the user the changed blowing condition by the user or the user's cancellation of the stopped blowing.

12. The image forming apparatus according to claim 9,
wherein the predetermined threshold value is configured to be changeable by a user, and
wherein the image forming apparatus further comprises a receiving unit which receives from the user the predetermined threshold value changed by the user.

13. The image forming apparatus according to claim 1,
wherein in a case where the image density detected by the detecting unit is higher than a predetermined threshold value, the blowing control unit controls the blowing unit not to blow the air to the sheets.

14. The image forming apparatus according to claim 13, further comprising:
a notification unit which notifies a user of information relating to the changed blowing condition or information relating to the stopped blowing in a case where the blowing condition is changed or the blowing is stopped without blowing the air to the sheets.

15. The image forming apparatus according to claim 13,
wherein the blowing condition changed by the blowing control unit is configured to be changeable by a user, or the stopped blowing of the air to the sheet is configured to be cancellable by the user, and
wherein the image forming apparatus further comprises a receiving unit which receives from the user the changed blowing condition by the user or the user's cancellation of the stopped blowing.

16. A non-transitory computer readable medium storing a program causing a computer to realize functions, the computer controlling an image forming apparatus comprising an image forming unit which forms an image on each of the sheets supplied from a container which contains a plurality of sheets and a blowing unit which blows air to the sheets contained in the container, the functions comprising:
a detection function of detecting an image density of the image formed on each of the sheets by the image forming unit; and
a control function of controlling the blowing unit based on the image density detected by the detection function.

17. The non-transitory computer readable medium according to claim 16,
wherein the control function controls the blowing unit based on the image density of the image formed on a region of each of the sheets in which air is blown by the blowing unit.

18. The non-transitory computer readable medium according to claim 16,
wherein the blowing unit provided in the image forming apparatus blows the air from an opening to the sheet,
wherein the detection function detects the image density of the image formed on a part located in a place of each of the sheets, close to the opening and detects the image density of the image formed on a part located in a place of each of the sheets, away from the opening, and
wherein the control function compares the image density detected by the detection function with a predetermined threshold value, performs the control based on the comparison result, uses a first threshold value as the threshold value, when comparing the image density of the image supposed to be formed on the part located in the place close to the opening with the threshold value, and uses a second threshold value, which is higher than the first threshold value, as the threshold value, when comparing the image density of the image supposed to be formed on the part located in the place away from the opening with the threshold value.

19. The non-transitory computer readable medium according to claim 16, wherein the blowing unit provided in the image forming apparatus, having a heating source, which heats the air with the heating source and blows the heated air to the sheet, wherein the detection function detects the image density of the image formed on each of a plurality of sheets contained in the container, and wherein the control function controls to lower an output of the heating source or to turn off the heating source in a case where the image density of the image formed on a single sheet out of the individual sheets constituting the plurality of sheets is higher than the predetermined threshold value, and lowers the output or turns off the heating source when lowering the output or turning off the heating source, if other sheet on which the image is supposed to be formed prior to the single sheet is still present in the container.

20. An image forming method comprising:

forming an image on each of a plurality of sheets supplied from a container which contains the plurality of sheets;

detecting an image density of the image formed on each of the sheets in the forming step;

blowing air to the sheets contained in the container; and controlling the blowing based on the image density detected in the detecting step.

* * * * *